United States Patent [19]

Murray et al.

[11] Patent Number: 4,893,813

[45] Date of Patent: Jan. 16, 1990

[54] BACK EXERCISE DEVICE

[76] Inventors: Christopher Murray, 2007 South Rd., Baltimore, Md. 21209; Binyamin Rothstein, 3213 Shelburne, Baltimore, Md. 21208

[21] Appl. No.: 245,262

[22] Filed: Sep. 16, 1988

[51] Int. Cl.[4] ..... A63B 1/02

[52] U.S. Cl. ..... 272/145; 128/71

[58] Field of Search ..... 272/144, 145; 128/71, 128/75

[56] References Cited

U.S. PATENT DOCUMENTS

| | | | |
|---|---|---|---|
| 2,240,228 | 4/1941 | Schall | 272/145 |
| 2,487,730 | 11/1949 | Robb | 272/144 |
| 3,685,511 | 8/1972 | Alvarez | 272/145 |
| 3,782,717 | 1/1974 | Berlin | 272/144 |
| 4,032,099 | 6/1977 | Maude | 272/144 |
| 4,182,511 | 1/1980 | Camp, Jr. | 272/145 |
| 4,461,287 | 7/1984 | Takahashi | 272/145 |
| 4,531,731 | 7/1985 | Law | 272/144 |
| 4,566,693 | 1/1986 | Seidentop et al. | 272/144 |
| 4,609,193 | 9/1986 | Paris et al. | 272/145 |

OTHER PUBLICATIONS

"Sporting Edge" magazine, Spring, 1988, p. 48, Abdominator.

Sync Catalog, Spring, 1988, p. 33, "Super Board".

ParaBody, Inc. Brochure "Bodysmith"; 1988.

Nautilus Brochure, 1988.

*Primary Examiner*—Richard J. Apley

*Assistant Examiner*—Howard Flaxman

*Attorney, Agent, or Firm*—Nixon & Vanderhye

[57] ABSTRACT

A back exerciser portable, stores in a collapsed position, accommodates people of all different sizes, and allows one to safely exercise all the muscle groups in one's back using resistance provided by one's own weight. First and second pairs of support legs are pivotally connected together at one end of each. Pivotal movement between a collapsed position and an operative position in which the legs of the supports have an angular relationship of about 45°-75° with respect to each other is provided, with positive stops supporting the legs in their maximum angular orientation. The first legs have an angle of about 20°-30° to the vertical. A platform is mounted for movement between a first position in which it is between and parallel to the legs of the first support, and a second position in wheich it is generally horizontal and disposed above the second support legs. With the platform in the first position one can exercise one's upper back by standing on rungs extending between the legs of the first support legs, engaging the platform which one's legs, and bending one's torso over the second support. With the platform in the horizontal position, one can exercise the lower back by laying on the platform, gripping the legs of the second support with one's hands, and raising one's legs separately or in unison to progressively tense the muscles of the lower back.

10 Claims, 6 Drawing Sheets

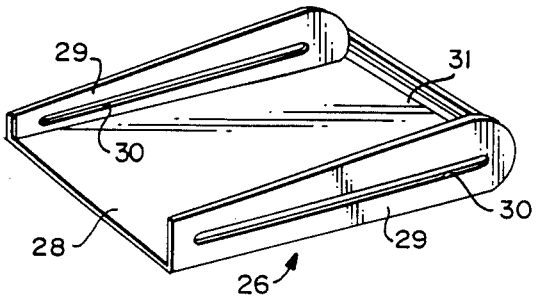
FIG. 7
FIG. 8
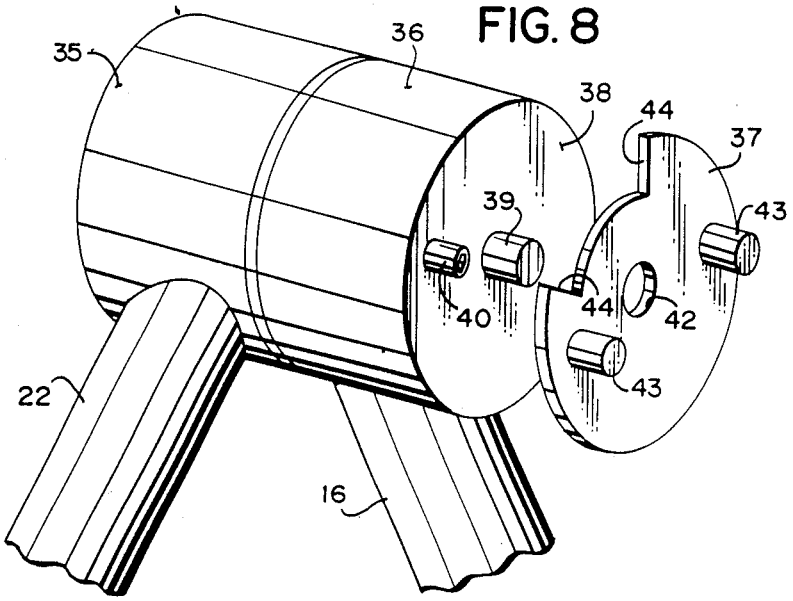
FIG. 9
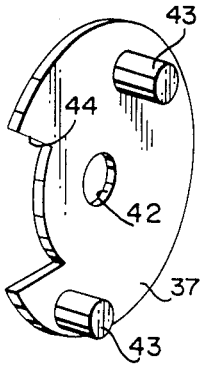
FIG. 13
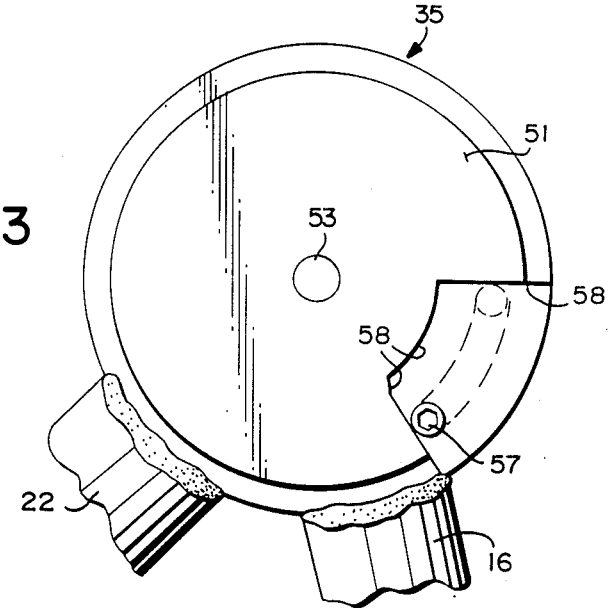

BACK EXERCISE DEVICE

BACKGROUND AND SUMMARY OF THE INVENTION

For many people, in order to obtain optimum health and vitality it is desirable to exercise one's back. However back exercises can be dangerous, and some back exercising apparatus—such as incline planes for sit-ups, and the like—are cumbersome and take up significant amounts of floor space.

According to the present invention, a back exerciser is provided which allows a wide variety of users of different size to safely exercise both the lower and upper back muscles. Only the user's own weight provides the resistance force for the exercises, and one can push oneself as far as desired using the exerciser, and therefore get a wide variety of different beneficial effects. The back exerciser according to the invention can easily be stored in a low volume configuration, out of sight, and is easy to use when deployed.

According to one aspect of the present invention, an exerciser device is provided which comprises: First support means. Second support means. Means connecting the first and second support means so that they are movable with respect to each other between a first, low volume, collapsed position, and a second, operative position in which the support means are disposed in a position with respect to each other to positively support the exerciser device on the ground. Platform means providing a surface for engaging and supporting the user's body; and, means for mounting the platform means to the first and second support means for movement between a first position in which it extends downwardly at an angle to the horizontal and is supported in that position, and a second position in which it extends generally horizontally and is supported in that position, so as to support the weight of a user.

The first support may comprise a pair of legs that are parallel to but spaced from each other with a cross bar at the bottom end and hubs at the top, while the second support may comprise a pair of legs with several cross bars and hubs at the top. The hubs are pivotally connected together to allow the movement of the supports between the collapsed and operative positions. An intermediate disc of low friction material is disposed between the sets of hubs to facilitate the rotation, while stop pins and surfaces are associated with the hubs to limit the pivotal movement therebetween. The platform includes a shell having a pair of flanges with elongated slots formed in the flanges. Discs are mounted to the hubs of the first support with alignment pins, the alignment pins received in the slots of the platform flanges, and the discs being rotatable with respect to the hubs. The hubs also include stop pins which cooperate with cut-out portions of the discs to positively stop movement of the platform in its first and second positions. Rungs extend between the legs of the first support.

Alternatively, the first and second supports can be pivotally connected adjacent an end thereof, with cooperating stop means being provided. The cooperating stop means include first and second stop elements mounted to the first and second support means, and stop arms for engaging the first and second stop elements to maintain the first and second support means in the second position of the device. The first stop element may comprise a channel-shaped member having an open side portion, and the means for mounting the platform may comprise a pair of arms having free ends opposite the platform. The free ends of the arms extend into the open side portion of the channel and abut interior portions of the channel to support the platform in the second position thereof. The second stop means may include a channel-shaped member having means defining grooves therein for receipt of the arms of the platform for supporting the platform arms in the first position thereof. Preferably a cushioning means covers the interconnection between the support means; the cushioning means may comprise a core element of flexible sheet material which will move with the first and second support means as they move between the first and second positions thereof, and padding disposed on top of the flexible sheet material.

Typically, in the second position of the support means the first support means makes an angle of about 20°–30° with respect to the vertical, and the first and second support means make an angle of about 45°–70° with respect to each other.

Using the exerciser described above, a method of exercising one's back may be provided according to the invention. The method comprises the following steps: Placing one's feet on a rung with the balls of one's feet over the rung and with one's legs abutting the platform; while the balls of one's feet are over the rung and the legs in contact with the platform, flexing one's body at the hips about a horizontal axis so as to suspend one's torso over the second support legs, to progressively tense the muscles of one's upper back; and repeatedly straightening one's back and continuously bending one's torso over the second support legs. Alternatively, the method may include the following steps: Moving the platform to a position in which it extends generally horizontally, over the second support legs, and is supported in that position; and then disposing one's weight on the platform, lowering one's arms to engage and grip the legs of the second support, and progressively raising one's legs either singly or in unison, above the ground, to progressively tense the muscles of the lower back.

It is the primary object of the present invention to provide a simple, readily and effectively utilizable back exerciser, and a method of exercising one's back utilizing the same. This and other objects of the invention will become clear from an inspection of the detailed description of the invention and from the appended claims.

BRIEF DESCRIPTION OF THE DRAWINGS

FIG. 7 is a bottom perspective view of the shell of the platform of the device of FIG. 1;

FIG. 8 is a detail perspective exploded view of platform mounting components of the device of FIG. 1;

FIG. 9 is a detail perspective view of the disc of FIG. 8 shown rotated into a position different than that illustrated in FIG. 8;

FIG. 13 is a end view of the components illustrated in FIG. 12, with the end cap removed for clarity of illustration;

DETAILED DESCRIPTION OF THE DRAWINGS

Figure 1:
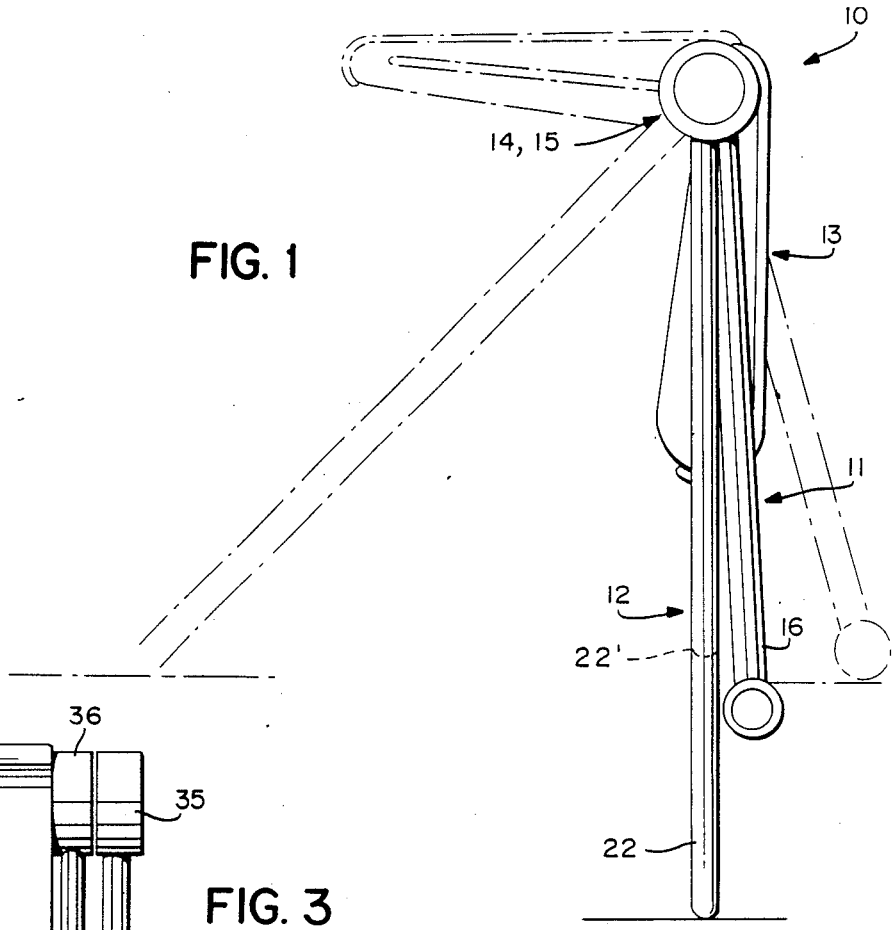
FIG. 1 is a side view of a back exerciser according to the present invention in a first, collapsed position.

An exemplary back exerciser according to the invention is shown by reference numeral 10 in the drawings. The major components of the exerciser 10 include the first support means 11, the second support means 12, the platform means 13, the means 14 for allowing movement of the platform to two different positions with respect to the supports, and the means 15 for providing for pivotal movement of the support means with respect to each other. These structures are shown merely generally in FIGS. 1 and 2, and in more detail in other figures.

Figure 3:
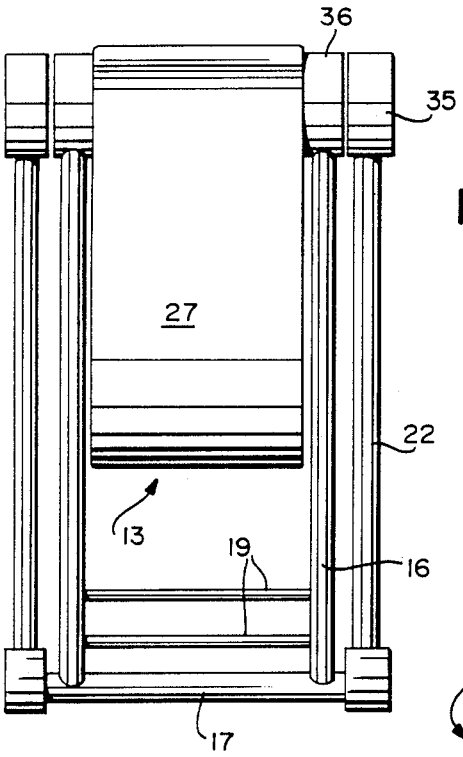
FIG. 3 is an end view of the device of FIG. 2 looking in at the platform end thereof.
Figure 5:
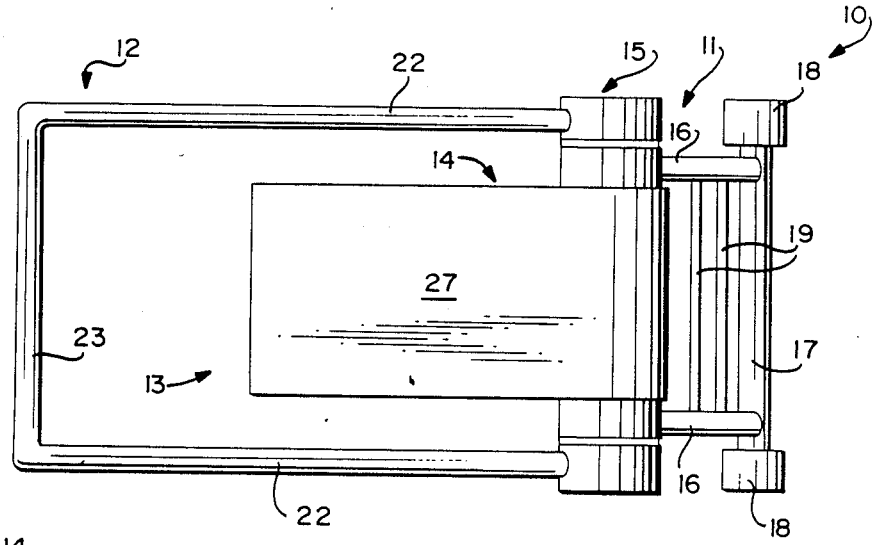
FIG. 5 is a top plan view of the back exerciser according to the invention disposed in the position illustrated in FIG. 4.
Figure 6:
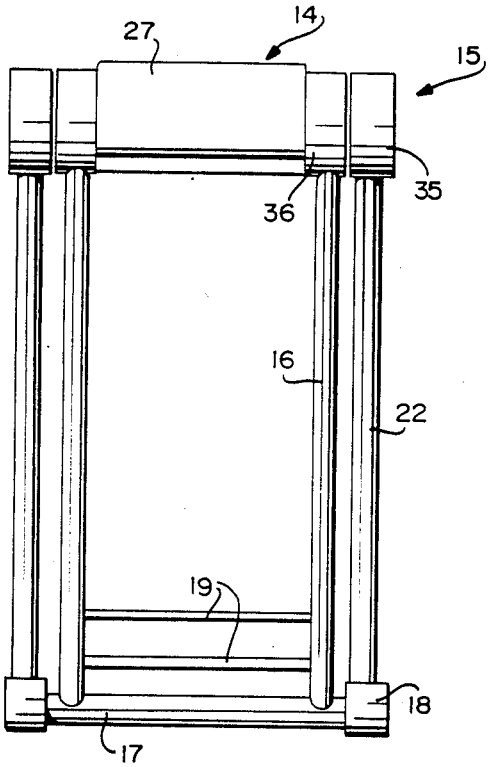
FIG. 6 is an end view like that of FIG. 3, only with the device in the position illustrated in FIG. 4.

The first support means 11 comprises a pair of legs 16, preferably of tubular metal, or plastic. The legs are connected together adjacent a second end thereof by a cross bar 17, which also preferably comprises a metal or plastic tube. The legs 16 may be welded to the tube 17. Attached to the ends of the cross bar 17 are plastic caps 18 (FIG. 5). One or a plurality of rungs 19 can extend between the legs 16 (FIGS. 3, 5, and 6). Adjacent the first ends of the legs 16 are hubs for connecting the legs 16 to the second support means 12 and the platform means 13, as will be described in detail hereafter.

The second support means 12 comprises a pair of legs 22 connected adjacent a second end thereof with a cross bar 23 (FIG. 5). Preferably the legs 22 and cross piece 23 are formed of the same integral piece of tubular metal, or plastic, which is bent in a substantially U-shape. Alternatively, as illustrated in dotted line at 22' in FIG. 1, the legs 22 may be formed so that they telescope so as to allow further compression of the volume of the device 10 when it is desired to store it. Similarly the legs 16 could be made so that they telescope. The legs 22 are connected adjacent the first ends thereof to hubs for interconnection to the first support means 11, as will be hereafter described.

Figure 4:
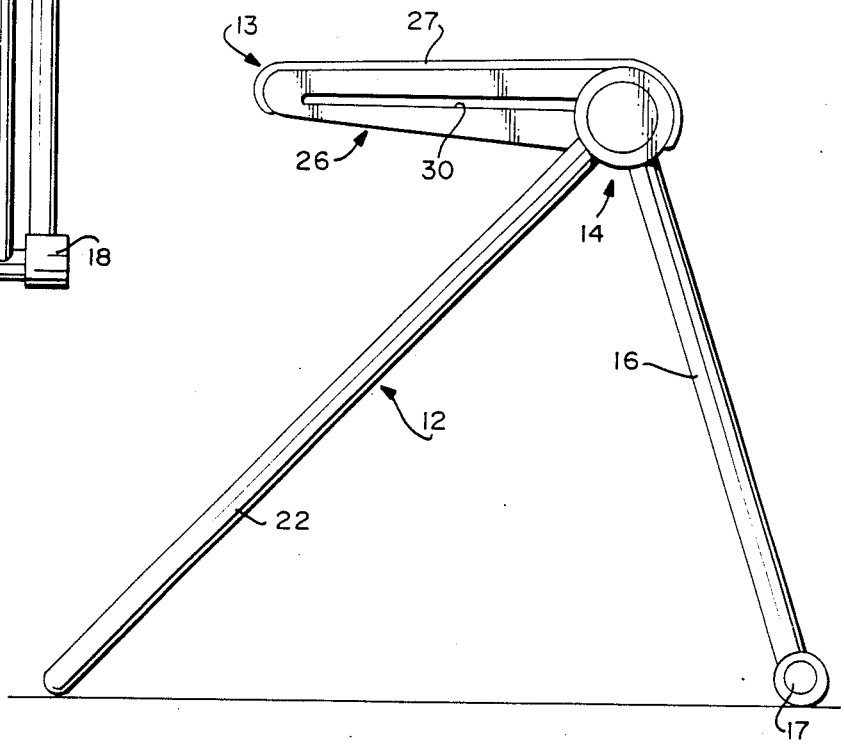
FIG. 4 is a side view of the device of FIGS. 1 and 2 only showing the platform in a horizontal position so that the user can exercise his/her lower back.
Figure 11:
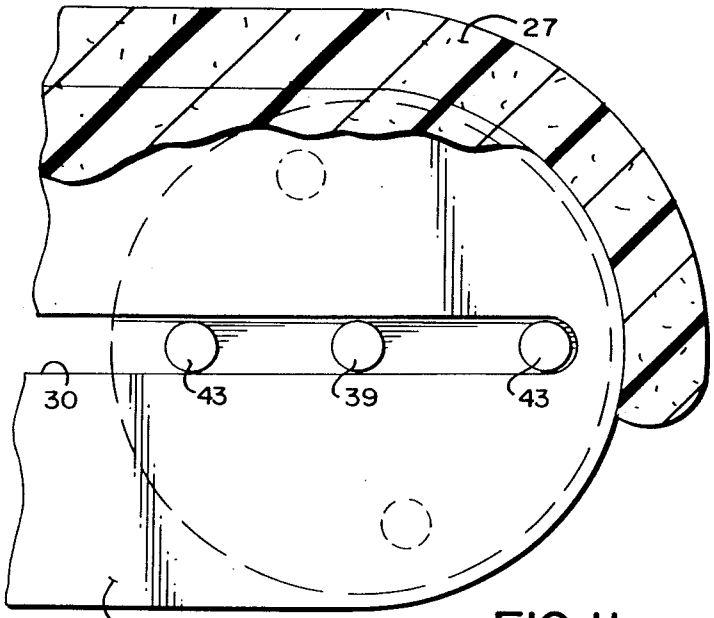
FIG. 11 is a detail view looking in along arrow 46 in FIG. 10.

The platform means 13 comprises an interior shell element 26, which is seen most clearly in FIGS. 7 and 4. The shell 26 is covered with a cushioning material 27, such as a skinned urethane foam which is adhered to the inner shell 26. The shell 26 may be of a rigid urethane plastic, metal, or like relatively rigid material.

As illustrated in FIG. 7, the shell 26 preferably comprises a substantially flat portion 28 which will serve as a platform surface, with a pair of flanges 29. One flange 29 is disposed along either edge of the platform 28 and extends generally perpendicular to it. Means for defining elongated slots 30 are also provided, the slots 30 being defined in the flanges 29. Adjacent to the end of the platform 28 and flanges 29 that is closest to the support means 11 when the platform means 13 is in the horizontal (FIG. 4) position, a cross-support piece 31 is provided.

The means 14 for interconnecting the support means (preferably the first support means 11) to the platform means 13, is illustrated most clearly in FIGS. 8 through 11. Note that each leg 35 is connected adjacent a first end thereof to a hub 35 while each leg 16 is connected adjacent a first end thereof to a hub 36. Each hub 36 comprises a short tubular section of rigid plastic or metal, or the like, having an inner face 38, and cooperating with a disc 37. Extending radially outwardly from the center of the face 38 is a pivot pin 39, and radially spaced from the pivot pin 39 extending generally parallel thereto is a stop pin 40. The face plate 38 preferably is welded to the hub tube 36, or otherwise rigidly attached to it.

The disc 37, which preferably is of nylon, Delrin, or like self-lubricating plastic, has means defining a central opening 42 therein which is just slightly larger than the pivot pin 39 of the same basic shape, to receive the pivot pin 39 therein. At least one, and preferably two or more alignment pins 43 are provided extending outwardly from the disc 37 parallel to the pivot pin 39, and so that there is a linear relationship between the pins 43, 39 when the opening 42 receives a pin 39. This is evident in both FIGS. 8 and 11. The face of the disc 37 containing the pins 43 abuts up against a flange 29 of the platform means 13. At this time, the pins 39, 43 are received within the elongated slot 30, the slot 30 having a linear extent significantly greater than the maximum spacing between the pins 43.

To cooperate with the stop pin 40 surface manifestations are provided on the disc 37. Preferably these take the form of the means defining the cut-out 44. The radially extending cut-out surfaces 44 abut the stop pin at the limit of rotation of the disc 37 with respect to the hub 36. The radially extending surfaces 44 would typically make an angle between each other of about 45° to 70°.

Figure 12:
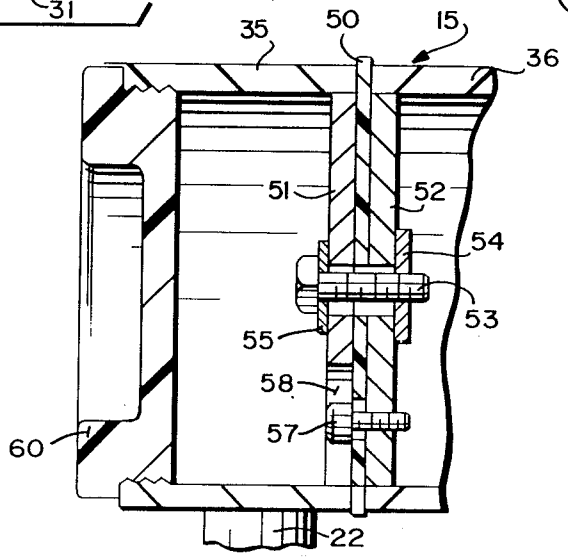
FIG. 12 is a side detail cross-sectional view showing the pivotal interconnection between a pair of adjacent hubs of the device of FIG. 1.
Figure 10:
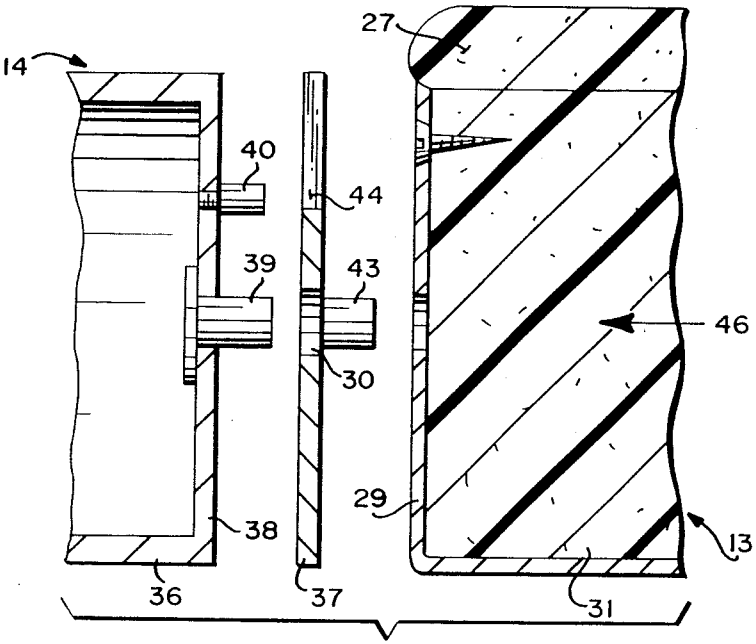
FIG. 10 is a side, exploded, detail cross-sectional view illustrating the manner in which the platform and hubs are interconnected.
Figure 15:
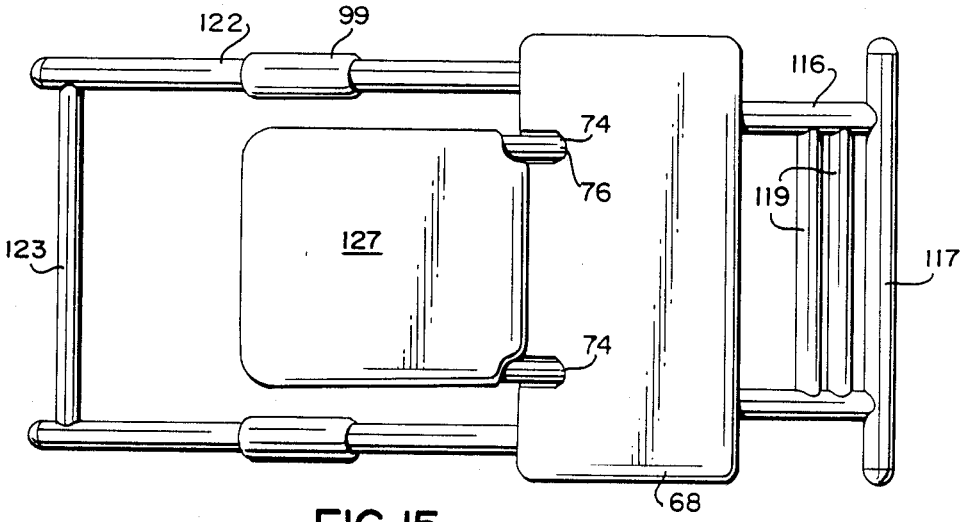
FIG. 15 is a top view of the exerciser of FIG. 14.

The means 15 for allowing movement of the support means 11, 12 between the collapsed (FIG. 1) and operative (FIGS. 2 through 6) position is illustrated most clearly in FIGS. 12 and 13. Such means includes an intermediate disc 50 (FIG. 12) between adjacent end plates 51, 52 of the hubs 35, 36 respectively. The end plates 51, 52 typically would be welded, or otherwise rigidly attached, to the interior surfaces of the hubs 35, 36. The intermediate disc 50 is of nylon, Delrin, or a like self-lubricating plastic, or other structure to allow relatively friction free rotation between the hubs 35, 36.

In order to provide secure connection of the hubs 35, 36 together while still allowing relative rotation therebetween the pivot means defined by the structures 53, 54, 55 are provided. Such pivot means include a centrally extending bolt 53 which extends through cooperating openings provided in the plates 51, 52 and the disc 50, and a weld nut having flanges 54, 55 at the opposite ends thereof. The distance between the flanges 54, 55 is slightly greater than the combined effective widths of the elements 50 through 52, to provide a small clearance while positively holding the structures together. The clearance would be on the order of about a tenth of an inch. The elements 50 through 52 can freely rotate about the pivot means 53 through 55.

The legs 16, 22 are welded, or otherwise affixedly attached, to the hubs 35, 36, respectively.

The means 15 further includes stop components for stopping the relative rotation between the hubs 35, 36. Such stop means preferably take the form of a stop pin 57 which extends radially outwardly from one of the plates 51, 52, parallel to the pivot bolt 53, and surface manifestations on the other plate 51, 52 for cooperating with the stop pin 57. In the exemplary embodiment illustrated in FIGS. 12 and 13, the stop pin 57 extends outwardly from the plate 52, while surface manifestations are provided on the plate 51, being defined by means forming a cut-out 58, the cut-out radially extending surfaces 58 adapted to abut the stop pin 57 in the extreme rotational positions of the hubs 35, 36 with respect to each other. Note that the angular relationship between the radially extending portions 58 of the cut-out are about 40°–70° .

As seen in FIG. 12, but removed for clarity of illustration in FIG. 13, an end cap 60 can be provided on the exterior face of the hub 35. For example the end cap 60 could be of plastic which is in screw-threaded relationship with the interior of the hub 35.

The components of the exerciser 10 are dimensioned so that the device will be stable in operating position and will allow maximum effective utilization of the device. Typically, the legs 22 would be slightly longer than the legs 16 so that when the device 10 is in the operative position (FIGS. 2 through 6) the legs 16 are closer to vertical than the legs 22. The angular relationship assumed by the legs 16, 22 in the operative position is also chosen so that the distance between the cross bars 18, 23 will be effective to provide great stability for the device so it is not likely to tip over. The maximum angular rotation provided for the platform means 13 by the means 14 will depend upon the operative angular position between the legs 16, 22, and other dimensions. In use, in order to get maximum benefit during upper back exercising, it is desired that the legs 16 make an angle of about 20°–30° with respect to the vertical. A larger angle might tend to destroy the effectiveness of exercising, calling different muscles into play, or tensioning of the muscles to come into play, while a lesser angle might make the device unstable under some circumstances.

An exemplary device 10 according to the invention having been described, a typical manner of utilization thereof, and method of performing back exercises therewith will now be described.

Figure 2:
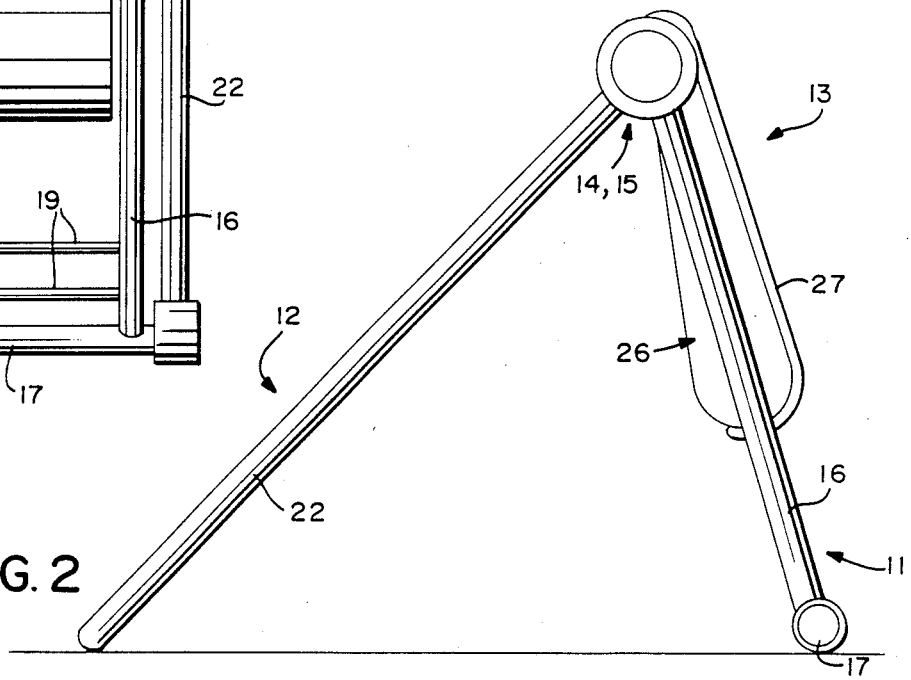
FIG. 2 is a view like that of FIG. 1 only showing the exerciser in an operative position, with the platform positioned so that the user can exercise his/her upper back.

The device 10 is moved from its low volume, collapsed, storage configuration illustrated in FIG. 1 to the operative position illustrated in FIGS. 2 through 6 merely by moving the ends of the legs 16, 22 adjacent the cross bars 17, 23 away from each other. This controlled movement is allowed by the pivotal connection between the hubs 35, 36 which includes the intermediate disc 50 and the pivot means 53–55. The legs 22, 16 are positively stopped in optimum position by engagement between the stop pin 57 and the cut-out surface 58 seen at the lowermost part of the plate 51 in FIG. 13. In the collapsed position (FIG. 1) the stop pin 57 engages the opposite radially extending cut-out surface 58. Of course more than one stop pin 57 may be provided, and/or the arcuate position assumed by the legs 22, 16 may be adjusted by adjusting the arcuate spacing of the stop pin 57.

In the operative position illustrated in FIGS. 2 through 6, the device 10 is sturdy and has little tendency to tip over. When the user desires to exercise his/her upper back muscles, he/she ensures that the platform means 13 is in the position illustrated in FIGS. 2 and 3, and then steps on whatever rung 19 is most comfortable depending upon the user's size. The user places the balls of his/her feet forward over the appropriate rung 19, and leans so that his/her legs abut the platform padded surface 27. Then the user flexes or rotates his/her body forward about the hips so that his/her torso bends about a horizontal axis over the second support 12. While rotating one's torso one also rotates the balls of his/her feet forward over the appropriate rung of the ladder. By suspending one's torso over the front of the device 10 (defined by the second support means 12), one progressively tenses the muscles of his/her upper back. As he/she lowers his/her head as far as is comfortable towards the floor, the muscles tense.

When it is desired to exercise the lower back, first the user must move the platform means 13 so that the platform extends generally horizontally. That is one moves the platform padded surface 27 from the position illustrated in FIGS. 2 and 3 to that illustrated in FIGS. 4 through 6. This is accomplished by first linearly moving (e.g. upwardly) the shell 26 with respect to the hub 35 so that the pins 43, 39 slide in the slots 30 from one end position thereof to the other. Once they are in the end position, the user rotates the shell 26 about a horizontal axis defined by the pins 39, which because of the engagement of the slots 30 with the pins 43 causes the platform 13 to rotate into the horizontal position. The engagement of the stop pin 40 by the cut-out radial surfaces 44 determines the rotational extent of movement possible, and defines the horizontal position of the platform 13. The positioning of the stop pins 57, 40 is coordinated so as to ensure that the platform is in a substantially horizontal position when the legs 16, 22 are in their operative, spread apart position. Note that in FIG. 8 the disc 37 is in a position in which the platform would be generally horizontal (the FIGS. 4 through 6 position) while in FIG. 9 the disc 37 is in the position in which the platform would extend parallel to the legs 16 (the FIGS. 1 through 3 position).

With the device 10 in the position illustrated in FIGS. 4 through 6, the user leans forward over the device 10, placing the weight of his/her torso on the surface 27 of the platform. The user then lowers his/her arms forward and grasps the legs 22 with his/her hands for stability. The user then progressively lifts and lowers his/her legs either one at a time, or in unison, to progressively tense the muscles of the upper back. When exercising is completed, the device may be neatly collapsed into the position illustrated in FIG. 1, and stored.

Another exemplary embodiment according to the present invention is illustrated in FIGS. 14 through 18. In this embodiment structures comparable to those in the FIG. 1 embodiment are shown by the same reference numeral only preceded by a "1".

Back exerciser device 110 includes first and second support means 111, 112 comprising legs 116, 122, respectively, with cross bars 117, 123, respectively. In this embodiment, the interconnections between the support arms are quite different than in the first embodiment, as is the interconnection between the platform 127 and the support means.

In the embodiment of FIGS. 14 through 18, cushioning means 68 are provided covering the tops of the support means 111, 112, and the support means are pivotally interconnected at the top thereof by pivot pins 69, which may be seen in each of FIGS. 14, and 16 through 18. The cushioning means 68 comprise a core of a flexible sheet material such as a ⅛ inch thick high molecular weight polyethylene sheet material, that is flexible enough to move with the legs 116, 122 as they are moved between the collapsed position of FIG. 16 and the use position of FIG. 14. The flexible sheet material is covered with padding, such as a high resilient polyurethane foam (2.5 pounds; 75-100 ICD).

The means for supporting the platform 127 for movement between the down position (dotted line in FIG. 14) and the horizontal position (solid line in FIGS. 14 and 15) includes arms extending outwardly from a rigid core of the padded platform 127. The arms are indicated generally by reference numeral 74, but have a portion 70 thereof immediately adjacent the platform 127, with a bend 71 between the portion 70 and the main body 74 of the arms. The arms have free ends 75 opposite the platform 127. The cushioning means 68 have means defining a cut out 76 (FIG. 15) therein to allow the arms 74 to swing from the dotted line position in FIG. 14 to the solid line position.

Also associated with the support means 111, 112 are stop means for positively stopping the support means 111, 112 in their relative places when moved to the second position (FIGS. 14 and 15) thereof. The stop means include stop arms 80, 81, and stop elements 82, 83 for engaging the arms 80, 81, respectively. The arms 80, 81 preferably comprise an integral piece of metal which is connected by the pivot pin 69 between the upper ends of respective legs 116, 122. The stop arms 80, 81 are adapted to engage the top surfaces of the stop elements 82, 83 when the legs 116, 122 have an angular relationship of about 45°-70° with respect to each other, which relationship may be adjusted by adjusting the position of the stop elements 82, 83 along the legs 116, 122.

Figure 14:
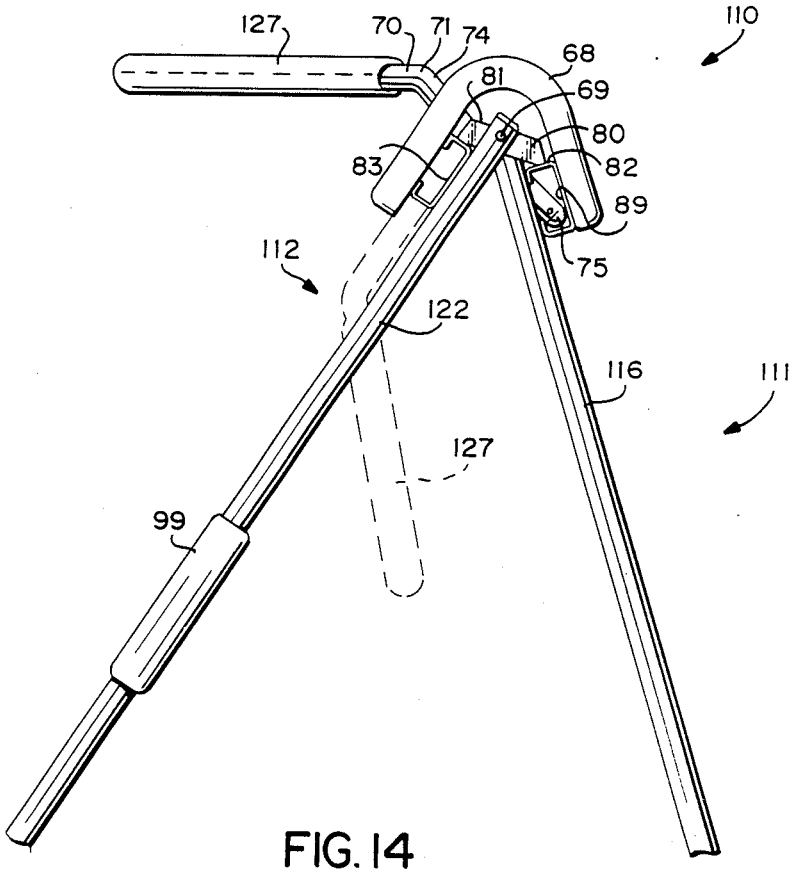
FIG. 14 is a side view of a second embodiment of a back exerciser according to the invention, showing the platform in two different use positions, one in solid line and one in dotted line.
Figure 18:
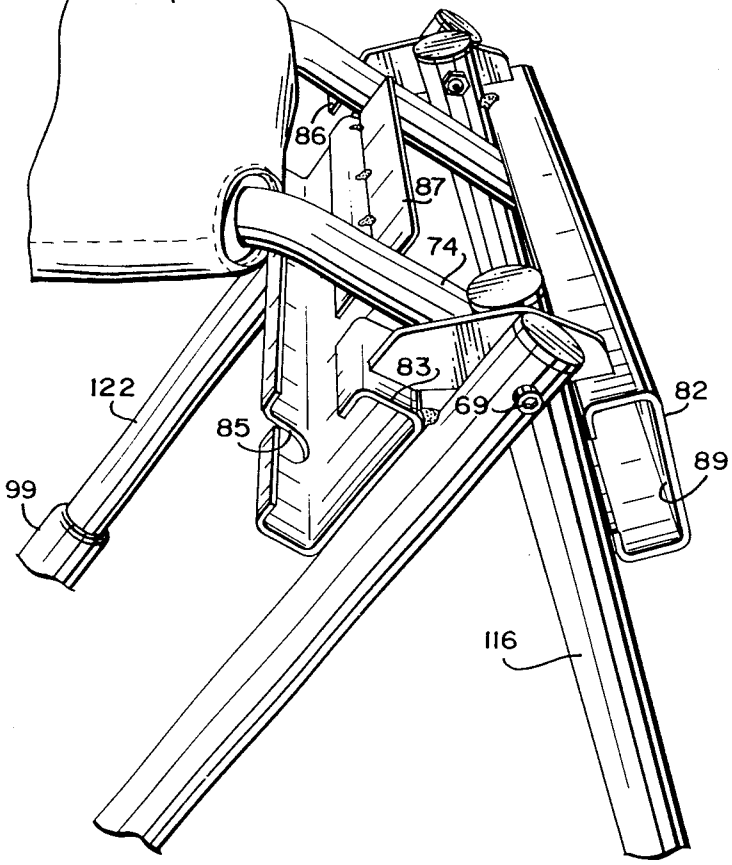
FIG. 18 is a view like FIG. 17 only showing the platform extending horizontally.
Figure 17:
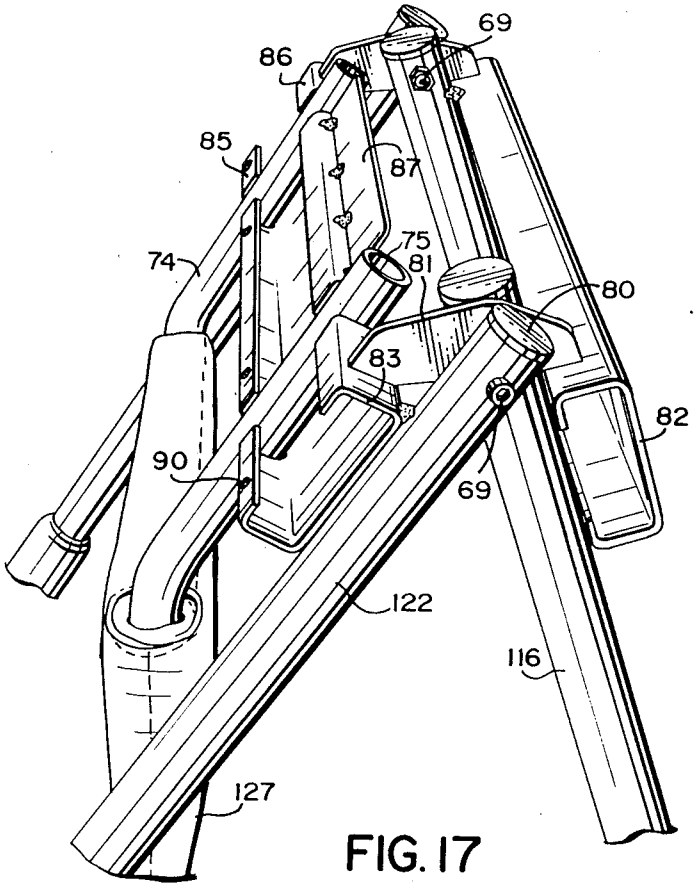
FIG. 17 is a top perspective partial view of the embodiment of FIGS. 14 through 16 with the top cushioning means removed for clarity of illustration, and with the platform extending downwardly.
Figure 16:
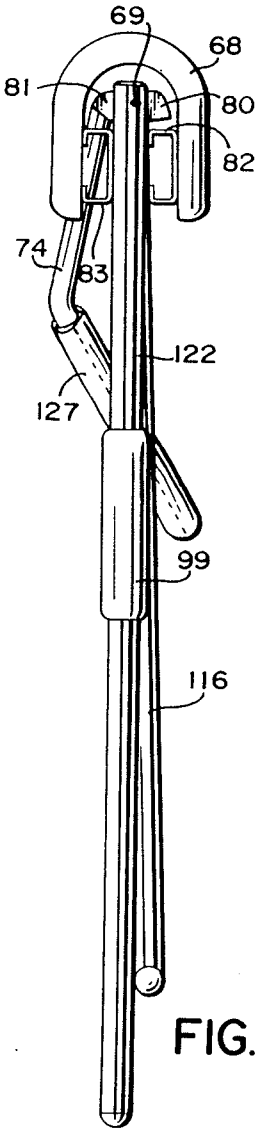
FIG. 16 is a view like that of FIG. 14 only showing the exerciser collapsed into a low volume configuration.

The stop elements 82, 83 preferably have the form of channel-shaped members. For example the element 82 has an open side 84 through which—as seen in FIGS. 14 and 18—the free ends 75 of the arms 74 may pass, and engage interior surfaces 89 of the element 82 to positively and securely support the platform 127 in the horizontal position. The channel-shaped member 83, on the other hand (in particular see FIGS. 17 and 18) includes means defining grooves 85, 86 therein for receipt of the arms 74 to positively support the arms when the platform 127 is in the downwardly extending position (the position in FIG. 17, and the dotted line position in FIG. 14). The platform 127 is readily moved between the dotted and solid line positions in FIG. 14 (in both of which it is positively supported) by merely sliding and pivoting the arms 74 when engaging the platform 127. If desired, cotter pins or like elements may be provided at the free ends 75 of the arms 74 to prevent them from moving out of the grooves 85, 86 in the downwardly extending position (of FIG. 17), and an extending flange 87 is provided to provide support for the cushioning means 68 which preferably is fastened to the channel-shaped elements 82, 83 by screws or the like passing through preformed openings (e.g. 90 in FIG. 17) therein.

In the embodiment of FIGS. 14 through 18, there preferably also are provided pistol grips 99 on the legs 122 which allows the user to more positively grasp the legs 122 when using the device 110 with the platform 127 in the horizontal position. The pistol grips 99 may be of any suitable material that allows firm grasping thereof. In general, the utilization of the device 110 is the same as the device 10.

It will thus be seen that according to the present invention a simple yet effective back exerciser, and method of exercising one's back, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. An exercise device for use by a human user, comprising:

(a) first support means;

(b) second support means;

(c) means connecting said first and second support means so that they are movable with respect to each other between a first, low volume, collapsed position, and a second, operative position in which the support means are disposed in a position with respect to each other to positively support the exerciser device on the ground;

(d) platform means providing a surface for engaging and supporting the user's torso; and (e) means for mounting said platform means to said first and second support means for movement between a first position in which it extends downwardly at an angle to the horizontal and is supported in that position, and a second position in which it extends generally horizontally and is supported in that position, so as to support the weight of a user whose torso is engaging said platform means; and wherein said platform means, in said second position, extends away from said first support means, and wherein said first support means comprises a pair of legs and a plurality of cross members extending between said legs at different heights along the lengths of said legs, said cross members adapted to receive the balls of a user's feet.

2. An exercise device for a human user, comprising:

a platform comprising an interior relatively rigid core with cushioning means surrounding said core for supporting a user's torso;

a first support having a pair of parallel legs with a cross bar extending therebetween adjacent a first, bottom, end thereof;

a second support having a pair of parallel legs with at least one cross bar extending therebetween;

means for pivotally connecting said first and second supports for movement with respect to each other for changing the angular relationship between said first and second supports;

stop means for positively stopping said first and second supports so that they cannot move any further angularly with respect to each other; and means for mounting said platform so that it is movable with respect to said supports and operatively positively supported thereby in at least first and second positions;

said platform including a pair of arms extending outwardly from the core thereof, and having free ends opposite said core; and wherein said means for mounting said platform receives said arms to positively support said arms in either a first position, in which said platform extends downwardly at an angle to the horizontal, or a second position, in which said platform extends generally horizontally; and wherein said platform in said second position thereof extends away from said first support, and wherein said first support comprises a plurality of cross bars extending between said parallel legs thereof, and positioned at different heights along said parallel legs, said cross bars being adapted to receive the balls of a user's feet.

3. An exercise device for use by a human user, comprising:

(a) first support means;

(b) second support means;

(c) means connecting said first and second support means so that they are movable with respect to each other between a first, low volume, collapsed position, and a second, operative position in which the support means are disposed in a position with respect to each other to positively support the exerciser device on the ground; said means comprising pivot means interconnecting said first and second support means adjacent an end thereof, and cooperating stop means including first and second stop elements mounted respectively to said first and second support means, and stop arms for engaging said first and second stop elements to maintain said first and second support means in said second position;

(d) platform means providing a surface for engaging and supporting the user's torso; and (e) means for mounting said platform means to said first and second support means for movement between a first position in which it extends downwardly at an angle to the horizontal and is supported in that position, and a second position in which it extends generally horizontally and is supported in that position, so as to support the weight of a user whose torso is engaging said platform means; and wherein said first stop element comprises a channel shaped member having an open side portion, and wherein said means (e) includes a pair of arms having free ends opposite said platform, said free ends entering the open side portion of said channel and abutting interior portions of said channel to support said platform in said second position thereof.

4. An exercise device for a human user, comprising:

a platform comprising an interior relatively rigid core with cushioning means surrounding said core for supporting a user's torso;

a first support having a pair of parallel legs with a cross bar extending therebetween adjacent a first, bottom, end thereof;

a second support having a pair of parallel legs with at least one cross bar extending therebetween;

means for pivotally connecting said first and second supports for movement with respect to each other for changing the angular relationship between said first and second supports;

stop means for positively stopping said first and second supports so that they cannot move any further angularly with respect to each other; and means for mounting said platform so that it is movable with respect to said supports and operatively positively supported thereby in at least first and second positions;

said platform including a pair of arms extending outwardly from the core thereof, and having free ends opposite said core; and wherein said means for mounting said platform receives said arms to positively support said arms in either a first position, in which said platform extends downwardly at an angle to the horizontal, or a second position, in which said platform extends generally horizontally; and said stop means including a pair of channel shaped members, one stationarily mounted to each of said first and second supports on the outside thereof adjacent said means for pivotally connecting said supports together.

5. An exercise device as recited in claim 1 wherein said platform means comprises a metal shell having cushioning means covering the surface of said shell adapted to be engaged by a user's torso.

6. An exercise device as recited in claim 3 wherein said second stop means includes a channel shaped member having means defining grooves therein for receipt of said arms of said platform for supporting said platform arms in said first position thereof.

7. An exercise device as recited in claim 6 further comprising cushioning means covering said means (c), including said channel shaped members and said arm free ends in both positions of said platform.

8. An exercise device as recited in claim 7 wherein said cushioning means comprises a core element of flexible sheet material which will move with said first and second support means as they move between said first and second positions thereof, and padding disposed on the top of said flexible sheet material.

9. An exercise device as recited in claim 5 wherein said metal shell comprises a substantially flat portion with a pair of side flanges, said flat portion having a length sufficient to support the user's torso.

10. An exercise device as recited in claim 5 wherein said metal shell comprises a substantially flat portion with a pair of side flanges, said flat portion having a length sufficient to support the user's torso.

* * * * *